US006495949B1

(12) United States Patent
Park et al.

(10) Patent No.: US 6,495,949 B1
(45) Date of Patent: Dec. 17, 2002

(54) ELECTRON TUBE CATHODE

(75) Inventors: Jae Dong Park, Kyung-Buk (KR); Hen Seg O, Taegu (KR)

(73) Assignee: Orion Electric Co., Ltd., Kyung-Buk (KR)

( * ) Notice: Subject to any disclaimer, the term of this patent is extended or adjusted under 35 U.S.C. 154(b) by 236 days.

(21) Appl. No.: 09/704,938

(22) Filed: Nov. 2, 2000

(30) Foreign Application Priority Data

Nov. 3, 1999 (KR) ..... 99-48289
Oct. 28, 2000 (KR) ..... 2000-63756

(51) Int. Cl.[7] ..... H01J 1/20; H01J 1/14
(52) U.S. Cl. ..... 313/346 R; 313/337; 313/346 DC; 313/355; 313/307
(58) Field of Search ..... 313/346 R, 355, 313/346 DC, 337

(56) References Cited

U.S. PATENT DOCUMENTS

| | | | | | |
|---|---|---|---|---|---|
| 4,494,035 | A | * | 1/1985 | Palluel et al. | 313/346 R |
| 4,737,679 | A | * | 4/1988 | Yamamoto et al. | 313/346 R |
| 5,757,115 | A | * | 5/1998 | Narita et al. | 313/346 R |
| 5,808,404 | A | * | 9/1998 | Koizumi et al. | 313/346 R |
| 6,140,753 | A | * | 10/2000 | Joo et al. | 313/346 R |
| 6,362,563 | B1 | * | 3/2002 | Chou et al. | 313/346 R |

FOREIGN PATENT DOCUMENTS

| | | |
|---|---|---|
| EP | 0445956 A2 | 9/1991 |
| JP | 2-267834 | 11/1990 |
| JP | 3-230445 | 10/1991 |
| KR | 93-11964 | 12/1993 |
| KR | 1999-0058901 | 10/1997 |
| KR | 1999-0058910 | 10/1997 |
| KR | 2002-0020817 | 10/1998 |

* cited by examiner

*Primary Examiner*—Ashok Patel
(74) *Attorney, Agent, or Firm*—Perman & Green, LLP

(57) ABSTRACT

An electron tube cathode is disclosed, comprising a base, electron emissive material layers formed on the base and containing alkaline earth metal oxides including barium, and reducing metal layers interposed between the emissive material layers. The metal layers comprise at least one metal selected from W, Mo, Ta and Ti. The metal layers further comprise any one of rhenium, yttrium or a mixture thereof in the amount of 3 to 5 wt % thereof. The amount of the entire metal layer is 8 to 15 wt % of the entire emissive layer comprising the emissive material layers and the metal layers. The entire metal layer has a thickness of 3 to 5 $\mu$m. Each of the metal layers comprise at least one or more layers formed by means of a spraying method.

The present invention provides advantages of enhancing emission characteristics and life characteristics of the cathode by increasing the amount of free Ba. The present invention further provides advantages of enabling an operation of the cathode at a lower temperature due to an increase of the radiant heat of the metal layer and the temperature of the cathode. The present invention also serves to enhance life characteristics of the cathode at a high current density of 3A/cm$^2$ as well as thermal characteristics of the cathode and reduce electric power consumption.

14 Claims, 3 Drawing Sheets

- PRIOR ART -

- PRIOR ART -

ELECTRON TUBE CATHODE

BACKGROUND OF THE INVENTION

1. Field of the Invention

The present invention relates to an electron tube cathode, and more particularly to an electron tube cathode enhancing life characteristics and electron emissivity by forming one or more reducing metal layer(s) between electron emissive material layers.

2. Description of the Related Art

In general, an electron tube cathode is a part emitting thermions as an electron source in an electron gun of a cathode ray tube for TV or a camera tube. The electron tube cathode is manufactured by forming an electron emissive material layer composed of electron emissive materials on a metal base. An example of a conventional electron tube cathode is disclosed in Japanese Patent Publication No. Sho 64-5417. As shown in FIG. 1, this electron tube cathode has a cathode sleeve 1 in which a heater 3 is placed. A base 5 is mounted on the upper opening of the cathode sleeve 1, and an electron emissive material layer 7 is formed on the base 5. The cathode sleeve 1 is composed of nichrome material, while the base contains a reducing material such as silicon (Si) or magnesium (Mg) by 0.01 to 0.09 wt % and is composed of high purity nickel (Ni) as a main ingredient. The electron emissive material layer 7 is composed as main ingredients of alkaline earth metal oxides including at least barium (Ba) and in addition strontium (Sr) or calcium (Ca). The electron emissive material layer 7 also contains rare earth metal oxide such as scandium oxide by 0.1 to 20 wt %. The heater 3 emits thermions from the electron emissive material layer 7 by means of electrical heating.

In order to form the electron emissive material layer 7 in an electron tube cathode having the structure described above, barium carbonate ($BaCO_3$), strontium carbonate ($SrCO_3$), calcium carbonate ($CaCO_3$) and a predetermined amount of scandium oxide ($Sc_2O_3$) are first mixed together with a binder and a solvent to prepare a suspension. The suspension is sprayed onto the base 5 to a thickness of about 800 $\mu$m and thereafter heated by a heater during the cathode ray tube evacuating process. At this time, the carbonates of the alkaline earth metals are converted into alkaline earth metal oxides such as barium oxide (BaO), strontium oxide (SrO) and calcium oxide (CaO). Thereafter, a part of the alkaline earth metal oxides are reduced and activated so as to have semi-conductivity. Thus, the electron emissive material layer 7 composed of a mixture of the alkaline earth metal oxides and a rare earth metal oxide is formed on the base 5. In the activating process, the reducing materials such as silicon and magnesium, which are contained in the base 5, move to the interface between the alkaline earth metal oxides and the base 5 by diffusion, and react with the alkaline earth metal oxides. As a result of these reactions, a part of the alkaline earth metal oxides on the base 5 are reduced to be an oxygen deficient semiconductor, thereby facilitating electron emission.

In the electron tube cathode described above, a reducing material layer may be formed on the base by means of a sputtering method before forming a carbonate layer by means of a spraying method. In addition, in order to enhance life characteristics, a mixture layer of the carbonates and the reducing materials, which function to lower resistance of the non-conductive intermediate layer formed on the base, may be formed on the surface of the base, or a carbonate layer may be formed on the mixture layer.

However, the process of forming a reducing material layer on the surface of the base by means of the sputtering method poses a problem of failing to uniformly emit electrons, since the reaction between the reducing material and the base metal is not uniformly made over the entire base metal in the evacuating and activating processes. In addition, a difficulty is encountered in managing the manufacturing process, when forming a carbonate layer on the mixture layer of the reducing materials and the carbonates after forming the mixture layer. Moreover, forming the entire emissive material layer with a mixture of the carbonates and the reducing materials is likely to result in undesirable cathode condition patterns.

Japanese Patent Laid-Open No. Hei 2-75128 discloses a cathode in which an oxide layer of alkaline earth metal including barium is formed on a nickel base and contains scandium, and a metal layer containing at least one element selected from platinum (Pt), iridium (Ir) and rhodium (Rh) is formed between the nickel base and the oxide layer.

In the electron tube cathodes having the structure described above, although the rare earth metal oxides improves the supply of excess Ba, since the excess Ba supplying rate is controlled by the diffusion rate of the reducing material in the nickel base, the life characteristics of the cathode are greatly deteriorated in operating at a high current density over 2 A/cm$^2$. Also, since the metal layer on the base is composed of a metal having a lower reducibility than tungsten (W) or molybdenum (Mo), it has almost no barium oxide reducing effect for enabling the operation at a high current density.

Japanese Patent Laid-Open Nos. Hei 3-230445 and Hei 2-267834 disclose a cathode composed of three emissive material layers. In Japanese Patent Laid-Open No. Hei 3-230445, a base is composed as a main ingredient of Ni containing reducing elements such as Si, Mg, etc., the first emissive material layer composed as main ingredients of alkaline earth metal oxides containing $Sc_2O_3$ of 0.05 to 5 wt % and Ba is formed on the base, the second emissive material layer composed as main ingredients of alkaline earth metal oxides including barium and containing at least one metal element selected from the 1B, 3B and 5B groups or oxide thereof by 0.01 to 5 wt % is formed on the first emissive material layer, and the third emissive material layer composed as main ingredients of alkaline earth metal oxides including barium is formed on the second emissive material layer.

In Japanese Patent Laid-Open No. Hei 2-267834, a base is composed as a main ingredient of Ni containing at least one reducing element, the first emissive material layer composed as main ingredients of alkaline earth metal including Ba is formed on the base, the second emissive material layer composed as main ingredients of at least one element selected from rare earth metal oxides, rare earth metals, heat resistant metal oxides and heat resistant metals is formed on the first emissive material layer, and the third emissive material layer composed as main ingredients of alkaline earth metal oxides including barium is formed on the second emissive material layer.

In case of a cathode having the structure consisting of three emissive material layers as described above, the reducing metal contained in the second layer exists in the form of a mixture with an emissive material. As mentioned above, however, this is likely to cause that the reaction between the reducing materials and the base metal may not uniformly occur over the entire base, and subsequently the electrons cannot be uniformly emitted. Also, the management of the manufacturing process is difficult, and undesirable cathode condition patterns are likely to be produced.

In Japanese Patent Laid-Open No. Hei 3-257735 and its counterpart U.S. Pat. No. 5,118,984, EP 445956, and Korean Patent Publication No. 93-11964, a base is composed as a main ingredient of Ni containing at least one reducing element selected from Si, Mg, W, zirconium (Zr) and aluminum (Al), a metal layer is formed on the base and contains at least one of W and Mo, and an emissive material layer composed as main ingredients of alkaline earth metal oxides including at least barium is formed on the metal layer and contains rare earth metal oxides of 0.01 to 25 wt %.

In this conventional cathode described above, as shown in FIG. 2, a heater 3 is arranged inside a cathode sleeve 1, a base 5 is arranged on the upper opening of the sleeve, an emissive material layer 7 is formed on the base 5, and a metal layer 9 is formed between the base 5 and the emissive material layer 7.

The cathode having the above-described structure produces a reactive product in addition to free barium atoms, and thus has stable characteristics at the beginning of use. As time elapse, however, the life characteristics are drastically deteriorated.

Korean Patent Laid-Open Nos. 99-58901, 99-58910 and 2000-20817 disclose a cathode comprising a metal layer formed between the base and an emissive material layer as a remedy to diffuse barium oxide, and a reactive product of silicon and Mg accumulated between the base and the emissive material layer, when generating a free barium atom.

In Korean Patent Laid-Open No. 99-58901, the base is composed of Ni as a main ingredient and contains at least one reducing element. A metal layer is formed on the base, and composed of W, Zr—W or W—Ni. An emissive material layer is formed on the metal layer and contains alkaline earth metal oxides including at least barium. The emissive material layer may further contain lanthanum (La) compound and Mg compound at the same time, or may contain La—Mg complex compound. Otherwise, an additional emissive material layer may be formed on the emissive material layer described above, which is composed of alkaline earth metal oxides including at least barium and contains La compound and Mg compound at the same time, or La—Mg complex compound. Korean Patent Lai-Open No. 99-58910 discloses a cathode of a similar structure to that of Korean Patent Laid-Open No. 99-58901 except that the metal layer is composed of Ni as a main ingredient. Korean Patent Laid-Open No. 2000-20817 also discloses a cathode of a similar structure to that of Korean Patent Laid-Open No. 99-58901 except that the metal layer is composed of Ni, W, Ni—Zr, Zr—W or Ni—W as a main ingredient and has a concave portion in the upper surface for increasing the surface area. The cathode may further comprise an additional metal layer composed as a main ingredient of Ni, W, Ni—Zr, Zr—W or Ni—W on the base.

In Korean Patent Laid-Open No. 99-58901, 99-58910 and 2000-20817, however, a layer composed of W, Zr—W or W—Zr is formed to have particles of smaller size than the average size of those in the base. Thus, despite a certain degree of diffusing effect of the intermediate layer, the cathode has a drawback of blocking a diffusing path of the reducing materials composed of Mg and Si as main ingredients due to formation of a barrier layer between the base and the emissive material layer.

In general, a cathode has a life cycle of about 10,000 hours. Most of Mg is consumed within the first 2,000 hours, and thereafter Si is mainly consumed as a reducing material. Of the numerous theories that have been suggested on the life cycle of a cathode, the most representative theory is that a moving amount of electrons is decreased due to a consumption of the reducing material as well as to an impediment of diffusion of the reducing material and an increase of resistance caused by an intermediate layer. As a result, there is a limit to enhance emission characteristics and life characteristics at a high current density.

SUMMARY OF THE INVENTION

It is, therefore, an object of the present invention to provide an electron tube cathode, which can enhance life characteristics at a high current density by forming a reducing metal layer between the emissive material layers.

It is another object of the present invention to provide an electron tube cathode, which can enhance emissive characteristics of electrons.

It is still another object of the present invention to provide an electron tube cathode, which can enhance thermal characteristics.

It is still another object of the present invention to provide an electron tube cathode, which can reduce loss of electric power.

To achieve the above object, there is provided an electron tube cathode according to an embodiment of the present invention, comprising: a base composed of Ni as a main ingredient and containing at least one reducing material; the first emissive material layer formed on the upper surface of the base and containing alkaline earth metal oxides including at least barium; a reducing metal layer formed on the first emissive material layer; and the second emissive material layer formed on the metal layer and containing alkaline earth metal oxides including at least barium.

Preferably, the metal layer may comprise at least one element selected from W, Mo, tantalum (Ta) and Ti.

The metal layer may further comprise any one of rhenium, yttrium or a mixture thereof. It is preferable that a total amount of any one of the above material is 3 to 5 wt % of the metal layer. It is also preferable that an amount of the metal layer is 8 to 15 wt % of the entire emissive layers comprising the first and second emissive material layers and the metal layer. The metal layer is preferably formed at the thickness of 3 to 5 $\mu$m. The metal layer may be formed to be at least one or more layers by means of spraying method.

There is also provided an electron tube cathode according to another embodiment of the present invention, comprising: a base composed of Ni as a main ingredient and containing at least one reducing material; at least three or more emissive material layers formed on the base and containing alkaline earth metal oxides including at least barium; and at least two or more reducing metal layers formed between the emissive material layers, respectively.

Preferably, the metal layers may comprise at least one element selected from W, Mo, Ta and Ti.

Also, the metal layers may further comprise any one of rhenium, yttrium or a mixture thereof. It is preferable that a total amount of any one of the above material is 3 to 5 wt % of the entire metal layer. It is also preferable that a total amount of the metal layers is 8 to 15 wt % of the entire emissive layer comprising the emissive material layers and the metal layers. The entire metal layer is preferably formed at the thickness of 3 to 5 $\mu$m. Each of the metal layers may be formed to be at least one or more layers by means of spraying method.

Therefore, according to the present invention, the reducing metal in the metal layer function to generate free Ba, thereby generating more amount of the free Ba in comparison with the conventional oxide cathode, and enhancing life characteristics and emissive characteristics at a high current density.

Further, use of a reducing metal in the metal layer also brings an effect of raising the temperature of the cathode due to an increase of the radiant heat of the metal layer within the emissive layer of the cathode comprising a metal layer and emissive material layers, thereby enabling an operation of the cathode at a lower operational temperature and reducing the electric power consumption while enhancing thermal characteristics.

BRIEF DESCRIPTION OF THE DRAWINGS

An embodiment of the present invention will now be explained hereunder with reference to the accompanying drawings. In the following description, same drawing reference numerals are used to refer to the same elements as the conventional art for clarity of description.

DETAILED DESCRIPTION OF THE PREFERED EMBODIMENT

Figure 3:
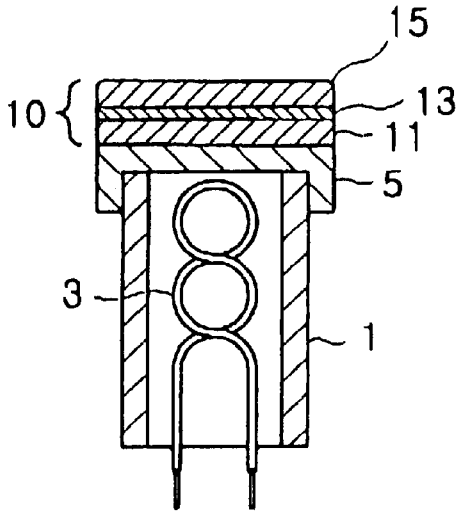
FIG. 3 is a cross-sectional view illustrating the structure of an electron tube cathode according to an embodiment of the present invention.

FIG. 3 is a cross-sectional view illustrating the structure of an electron tube cathode according to an embodiment of the present invention. Referring to FIG. 3, the electron tube cathode comprises: a base 5 of a cap shape mounted on the upper opening of a cathode sleeve 1; the first emissive material layer 11 formed on the base 5; a reducing metal layer 13 formed on the first emissive material layer 11; and the second emissive material layer 15 formed on the metal layer 13. A heater 3 of a nichrome material is paced inside the cathode sleeve 1. The entire emissive layer 10 comprises the first and the second emissive material layers 11, 15 and the metal layer 13.

Here, the base 5 contains a reducing material of 0.01 to 0.09 wt % such as Si and Mg, and is composed of high purity Ni as a main ingredient. The first and the second emissive material layers 11, 15 are composed as main ingredients of alkaline earth metal oxides including at least Ba and, in addition, Sr or Ca and further contain rare earth metal oxides such as scandium oxide, yttrium oxide, etc.

The metal layer 13 comprises any one metal selected from 3B, 4B, 5B, 6B and 7B groups. The metal layer 13 may also comprise two or more metals selected from 3B, 4B, 5B, 6B and 7B groups. Preferably, the metal layer 13 comprises any one metal selected from the reducing metals such as W, Mo, Ta and Ti. Of course, the metal layer 13 may comprise two or more metals selected from W, Mo, Ta and Ti.

The metal layer 13 may further comprise rhenium, preferably in the amount of 3 to 5 wt % thereof. The metal layer 13 may further comprise yttrium, preferably in the amount of 3 to 5 wt % thereof. The metal layer 13 may further comprise a mixture of rhenium and yttrium, preferably in the amount of 3 to 5 wt % thereof.

The entire emissive layer 10 including the first and the second emissive material layers 11, 15 and the metal layer 13 preferably has a thickness of 60 to 100 $\mu$m, and more preferably has a thickness of about 70 $\mu$m. The amount of metal layer 13 is preferably 8 to 15 wt % of the entire emissive layer 10. The metal layer 13 has a thickness of 4 to 12 $\mu$m, and preferably of 3 to 5 $\mu$m. The metal layer 13 may be formed by a spraying method or other ordinary methods.

In FIG. 3, although the metal layer 13 is shown as a single layer to have a thickness of 3 to 5 $\mu$m, it would be obvious that in actual the single layer may consist of multiple layers, at least two or more, each of which is thinner than 3 to 5 $\mu$m. In that case, each of the multiple layers can be formed by a spraying method. Thereafter, a heat treatment is required to utilize the interfacial characteristics between the multiple layers, thereby enhancing the characteristics of the cathode.

A method of forming the emissive material layers and the metal layer of the electron tube cathode according to the present invention will now be described in detail.

A lower portion of the base 5, which contains a reducing material of 0.01 to 0.09 wt % such as Si or Mg and is composed of Ni of high purity as a main ingredient, is welded to the upper opening of the cathode sleeve 1. The first emissive material layer 11, which is composed as main ingredients of alkaline earth metal oxides including at least Ba and, in addition, Sr or Ca and further contains rare earth metal oxides such as scandium oxide, yttrium oxide, is formed on the upper surface of the base 5 by means of a spraying method.

Thereafter, the metal layer 13 is formed on the first emissive material layer 11 by spraying any one metal selected from 3B, 4B, 5B, 6B and 7B groups. Of course, it is possible to form the metal layer 13 by spraying two or more metals selected from 3B, 4B, 5B, 6B and 7B groups on the first emissive material layer 11.

To be specific, the metal layer 13 is formed on the first emissive material layer 11 by spraying any one metal selected from the reducing metals such as W, Mo, Ta and Ti, for example, W. Of course, it is possible to form the metal layer 13 by spraying two or more metals selected from W, Mo, Ta and Ti on the first emissive material layer 11.

Here, the metal layer 13 may further comprise rhenium, preferably in the amount of 3 to 5 wt % thereof. Of course, the metal layer 13 may further comprise yttrium, preferably in the amount of 3 to 5 wt % thereof. The metal layer may further comprise a mixture of rhenium and yttrium, preferably in the amount of 3 to 5 wt % thereof. This is to suppress a decrease of maximum current of the cathode according to the life cycle thereof.

The metal layer 13 is preferably 8 to 15 wt % of the entire emissive layer 10 comprising the first and the second emissive material layers 11, 15 and the metal layer 13. The metal layer 13 is formed to have a thickness of 4 to 12 $\mu$m, and preferably of 3 to 5 $\mu$m.

In FIG. 3, the metal layer 13 is shown as if it comprises a single layer having a thickness of 3 to 5 $\mu$m. In fact, however, it would be obvious to those skilled in the art that the metal layer 13 may be formed with a plurality of layers having a far less thickness than 3 to 5 $\mu$m by a repeated spraying process. In that case, a heat treatment is required once after each of the plurality of layers is formed by means of the spraying method, for the purpose of enhancing the cathode characteristics by utilizing interfacial characteristics between the layers.

As a last step, the electron tube cathode according to the present invention is completed by forming the second emissive material layer 15, which is composed of the same material as the first emissive material layer 11, by means of the spraying method. Here, the entire emissive layer 10 comprising the first and the second emissive material layers 11, 15 and the metal layer 13 preferably has a thickness of 60 to 100 $\mu$m, and more preferably about 70 $\mu$m.

Formation of the first and the second emissive material layers 11, 15 and the metal layer 13 may be realized by means of a physical, chemical or a mechanical method such as a printing method, an electrodeposition method or a metallic salt solution method instead of the spraying method.

Figure 5:
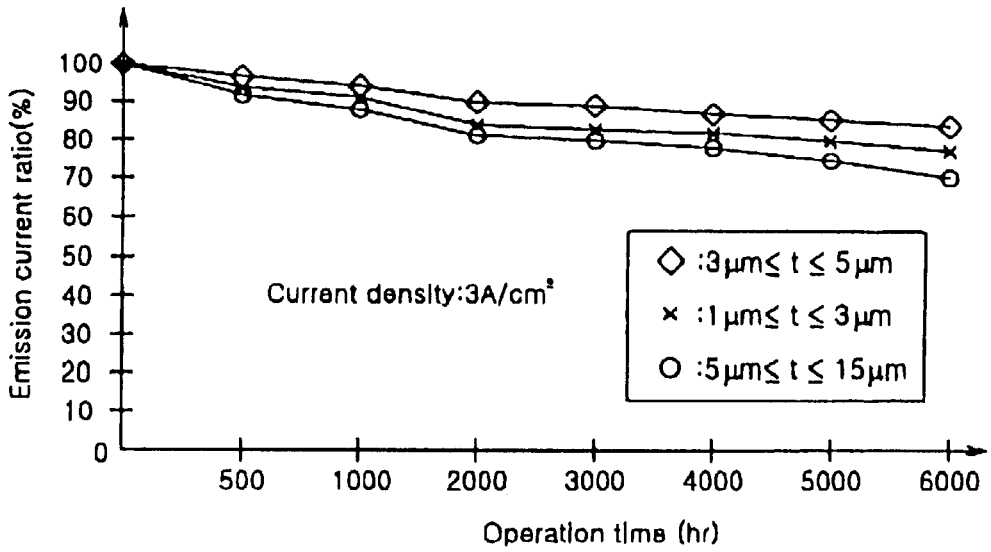
FIG. 5 is a graph illustrating emission characteristics of electrons in the electron tube cathode according to an embodiment of the present invention.

FIG. 5 shows a result of a measurement of decreasing amount of the emission current of electrons during the operation of 6,000 hours of the electron tube cathode according to the pre sent invention. Th e samples of the metal layer 13 have thickness arrangements of 3 $\mu m \leqq t \leqq 5$ $\mu$m, 1 $\mu m \leqq t \leqq 3$ $\mu$m, and 5 $\mu m \leqq t \leqq 15$ $\mu$m, respectively. Here, "t" represents a thickness of the metal layer 13. The measurement was made under the conditions of 6.3V filament voltage, 150 $\mu$A cathode current, and 25 KV direct current volt age o n anode.

As shown in FIG. 5, the emission current is least decreased according to an operation time in the sample where the thickness of the metal layer 13 is arranged to be 3 $\mu m \leqq t \leqq 5$ $\mu$m. The emission current is most decreased according to an operation time in the sample where the thickness of the metal layer 13 is arranged to be 5 $\mu m \leqq t \leqq 15$ $\mu$m. The emission current is reduced in the mid-level according to an operation time in the sample where the thickness of the metal layer 13 is arranged to be 1 $\mu m \leqq t \leqq 3$ $\mu$m. Accordingly, it is preferable that the metal layer 13 has a thickness range of 3 to 5 $\mu$m.

Figure 1:
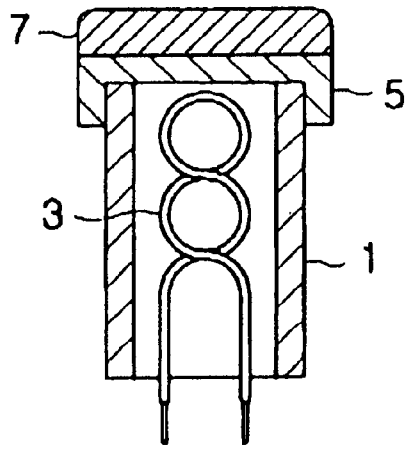
FIG. 1 is a cross-sectional view illustrating the structure of an electron tube cathode in general type.
Figure 2:
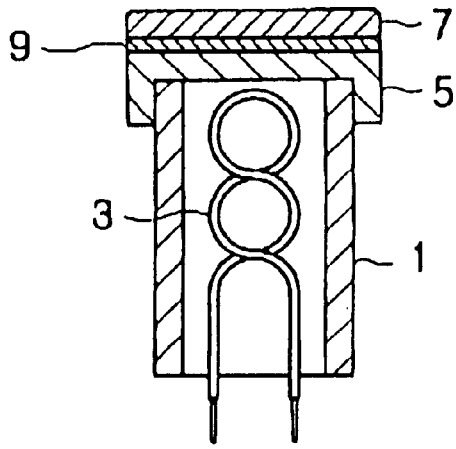
FIG. 2 is a cross-sectional view illustrating the structure of a conventional electron tube cathode.
Figure 6:
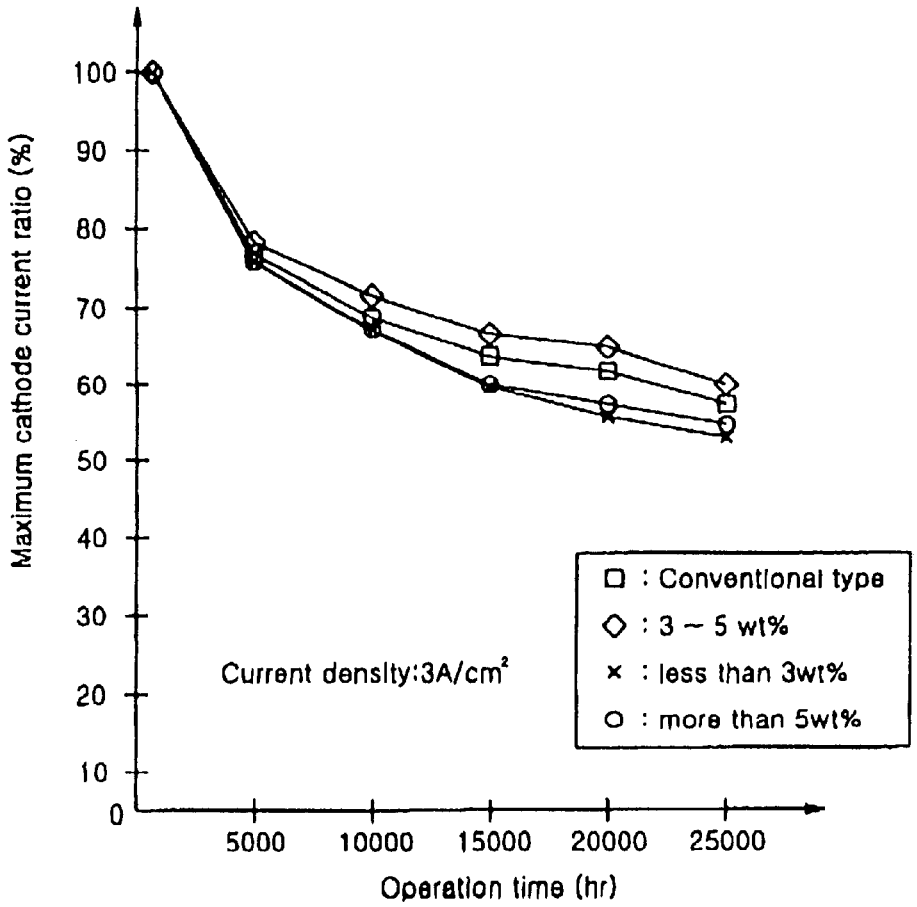
FIG. 6 is a graph illustrating life characteristics of the electron tube according to an embodiment of the present invention.

FIG. 6 shows a result of measurement of the decreasing amount of the maximum current of the cathode during the life cycle of 25,000 hours made at a current density of 3 $A/cm^2$ with respect to the electron tube cathode according to the present invention in comparison with the conventional type cathode shown in FIG. 2. Here, the conventional type cathode is an oxide cathode.

As shown in FIG. 6, the maximum cathode current is less decreased than that of the conventional type in case where the amount of any one of rhenium, yttrium or a mixture thereof, which is additionally contained in the metal layer 13, is 3 to 5 wt % of the metal layer 13. The maximum cathode current is more decreased than that of the conventional type in case where the amount of any one of the above elements is less than 3 wt % of the metal layer 13. The maximum cathode current is far more decreased than that of the conventional type in case where the amount of any one of the above elements is more than 5 wt % of the metal layer 13. Accordingly, any one of rhenium, yttrium or a mixture thereof, which is contained in the metal layer 13, preferably consists of 3 to 5 wt % of the metal layer 13.

Meanwhile, the emissivity of electrons of a cathode depends on the amount of excess Ba in the oxides. For instance, W in the metal layer 13, which contains at least one of rhenium or yttrium added by 3 to 5 wt % in the emissive layers in addition to the free Ba produced by a reducing operation of Mg and Si contained in the base metal, reacts in accordance with the following formula:

$$2BaO+1/3W=Ba+1/3Ba_3WO_4$$

$$2BaO+1/3Re=Ba+1/3Ba_3ReO_4$$

$$1/2Ba_2 2SiO_4+4/3Y=Ba+1/2Si+2/3Y_2O_3$$

As shown in the above formula, the W powder layer has a relatively weaker reducibility than Mg or Si. However, it produces more quantity of free Ba than the conventional cathode by means of continuous reducing reactions. Further, yttrium contributes to production of free Ba by decomposing a by-product as shown above.

By inserting a reducing metal layer between the emissive material layers according to the present invention, suppression against the diffusion of the reducing metals (Mg, Si), which used to be generated by forming the reducing metal layer on the upper surface of the base as in the conventional type, can be avoided.

Figure 4:
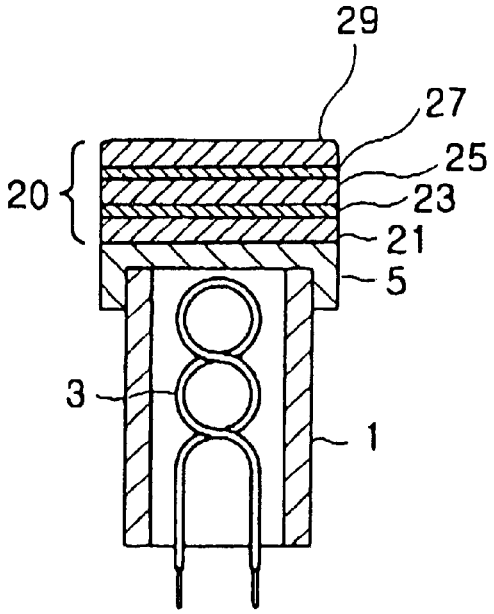
FIG. 4 is a cross-sectional view illustrating the structure of an electron tube cathode according to another embodiment of the present invention.

FIG. 4 is a cross-sectional view illustrating the structure of an electron tube cathode according to another embodiment of the present invention. The same reference numerals are used for the same elements as in FIG. 3.

Referring to FIG. 4, the electron tube cathode comprises: a base 5 of a cap shape mounted on the upper opening of a cathode sleeve 1; the first emissive material layer 21 formed on the base 5; the first metal layer 23 formed on the first emissive material layer 21, for instance, by means of a spraying method; the second emissive material layer 25 formed on the first metal layer 23; the second metal layer 27 formed on the second emissive material layer 27, for instance, by means of the spraying method; the third emissive material layer 29 formed on the second metal layer 27. A heater 3 of a nichrome material is placed inside the cathode sleeve 1.

Here, the entire emissive layer 20 comprises the first emissive material layer 21, the first metal layer 23, the second emissive material layer 25, the second metal layer 27 and the third emissive material layer 29. The entire metal layer comprises the first metal layer 23 and the second metal layer 27.

Also, the first, the second and the third emissive material layers 21, 25, 29 are composed as main ingredients of alkaline earth metal oxides including at least Ba and, in addition, Sr or Ca and further contain rare earth metal oxides such as scandium oxide, yttrium oxide, etc.

The first and the second metal layers 23, 27 are composed of the same material and with same thickness. Of course, the first and the second metal layers 23, 27 may be composed of the same material but with different thickness. The first and the second metal layers 23, 27 comprise any one metal selected from 3B, 4B, 5B, 6B and 7B groups, or two or more metals selected from the metal groups consisting of 3B, 4B, 5B, 6B and 7B groups.

Preferably, the first and the second metal layers 23, 27 comprise any one metal selected from the reducing metals such as W, Mo, Ta and Ti. Of course, the first and the second metal layers 23, 27 comprise two or more metals selected from W, Mo, Ta and Ti.

The first metal layer 23 further comprises any one of rhenium, yttrium or a mixture thereof. Also, the second metal layer 27 further comprises any one of rhenium, yttrium or a mixture thereof. Here, the total amount of the materials contained in the entire metal layer comprising the first and the second metal layers is 23, 27 preferably 3 to 5 wt % of the entire metal layer.

Also, the amount of the entire metal layer is preferably 8 to 15 wt % of the entire emissive layer 20. The entire thickness of the entire metal layer is 4 to 12 μm, and preferably determined to be 3 to 5 μm for the purpose of suppressing the decrease of the emission current in accordance with the operation time. The metal layers 23, 27 may be formed using the spraying method or other ordinary methods.

Meanwhile, FIG. 4 illustrates as if the metal layers 23, 27 comprise a single layer for the sake of description. However, it would be obvious to those skilled in the art that the metal layer 23 may be formed with a plurality of layers, at least two or more, each having far less thickness than that of the metal layer 23 itself, and that the metal layer 27 may also be formed with a plurality of layers, at least two or more, each having far less thickness than that of the metal layer 27 itself.

A detailed description of the electron tube cathode according to another embodiment of the present invention will be omitted because of its similarity to the first embodiment of the present invention.

Also, for the sake of description, FIG. 4 exemplifies an electron tube cathode comprising two metal layers 23, 27 and three emissive material layers 21, 25, 29. However, it would be obvious to those skilled in the art that an electron tube cathode comprising much more metal layers and much more emissive material layers is also available according to the present invention.

As described above, the present invention provides an electron tube cathode, in which emissive material layers containing alkaline earth metal oxides including at least barium is formed on a base, and at least one or more reducing metal layers are formed between the emissive material layers. The metal layers comprise at least any one metal selected from W, Mo, Ta and Ti. The metal layers further comprise at least one of rhenium or yttrium in the amount of 3 to 5 wt %. The amount of the metal layers is 8 to 15 wt % of the entire emissive layer comprising the metal layers and the emissive material layers. The entire metal layer comprising those metal layers are formed to have a thickness of 3 to 5 μm by means of a spraying method. Further, each of the metal layers may comprise a plurality of layers having far less thickness than that of a metal layer itself as a result of the repeated spraying process. Once after each of the metal layers is formed by means of the spraying method, a heat treatment is required for the purpose of enhancing the cathode characteristics by utilizing the interfacial characteristics between the layers.

Accordingly, the present invention provides an effect of enhancing emission characteristics and life characteristics of the cathode by increasing the amount of free Ba. Furthermore, an addition of a reducing material results in an increase of a radiant heat of the metal layers as well as of a temperature of the cathode. Therefore, the cathode can be operated at a lower temperature. Moreover, the life characteristics of the cathode are enhanced while the electric power consumption is reduced and thermal characteristics is enhanced. Thus, the cathode according to the present invention realizes an electron tube of high luminance and high resolution, which have been difficult to be achieved by the conventional cathode.

While the invention has been shown and described with reference to preferred embodiments thereof it will be under stood by those skilled in the art that various changes in form and details may be made therein without departing from the spirit and scope of the invention as defined by the appended claims.

What is claimed is:

1. An electron tube cathode comprising:

a base composed of nickel as a main ingredient and containing at least one reducing material;

a first emissive material layer formed on the upper surface of the base and containing alkaline earth metal oxides including at least barium;

a reducing metal layer formed on the first emissive material layer; and a second emissive material layer formed on the metal layer and containing alkaline earth metal oxides including at least barium.

2. The electron tube cathode of claim 1, wherein the metal layer comprises at least one metal selected from tungsten, molybdenum, tantalum and titanium.

3. The electron tube cathode of claim 2, wherein the metal layer further comprises any one of yttrium, rhenium or a mixture thereof.

4. The electron tube cathode of claim 3, wherein the total amount of any one of yttrium, rhenium or the mixture thereof is 3 to 5 wt % of the metal layer.

5. The electron tube cathode of claim 1, wherein the amount of the metal layer is 8 to 15 wt % of the entire emissive layer comprising the first and the second emissive material layers and the metal layer.

6. The electron tube cathode of claim 5, wherein the metal layer has a thickness of 3 to 5 μm.

7. The electron tube cathode of claim 6, wherein the metal layer comprises at least one or more layers formed by a spraying method.

8. An electron tube cathode comprising:

a base composed of nickel as a main ingredient and containing at least one reducing material;

at least three or more emissive material layers formed on the base and containing alkaline earth metal oxides including at least barium; and at least two or more reducing metal layers formed between the emissive material layers, respectively.

9. The electron tube cathode of claim 8, wherein the metal layers comprise at least one element selected from tungsten, molybdenum, tantalum and titanium.

10. The electron tube cathode of claim 9, wherein the metal layers further comprises any one of rhenium, yttrium or a mixture thereof.

11. The electron tube cathode of claim 10, wherein the total amount of any one of rhenium, yttrium or the mixture thereof is 3 to 5 wt % of the entire metal layers.

12. The electron tube cathode of claim 8, wherein the amount of the entire metal layer is 8 to 15 wt % of the entire emissive layer comprising the emissive material layers and the metal layers.

13. The electron tube cathode of claim 12, wherein the entire metal layers has a thickness of 3 to 5 μm.

14. The electron tube cathode of claim 13, wherein each of the metal layers of the entire metal layer comprises at least one or more layers formed by a spraying method, respectively.

* * * * *